US011053108B2

(12) United States Patent
Krulitsch et al.

(10) Patent No.: US 11,053,108 B2
(45) Date of Patent: Jul. 6, 2021

(54) METHOD, AS WELL AS TREATMENT STATION AND TREATMENT HEAD FOR TREATING THE INTERIOR OF KEGS, AND SEAL FOR USE IN A TREATMENT STATION OF THIS TYPE

(71) Applicant: KHS GmbH, Dortmund (DE)

(72) Inventors: Dieter-Rudolf Krulitsch, Bad Kreuznach (DE); Sebastian Eckes, Sprendlingen (DE)

(73) Assignee: KHS GmbH, Dortmund (DE)

( * ) Notice: Subject to any disclaimer, the term of this patent is extended or adjusted under 35 U.S.C. 154(b) by 522 days.

(21) Appl. No.: 15/764,519

(22) PCT Filed: Aug. 31, 2016

(86) PCT No.: PCT/EP2016/070480

§ 371 (c)(1),
(2) Date: Mar. 29, 2018

(87) PCT Pub. No.: WO2017/054999

PCT Pub. Date: Apr. 6, 2017

(65) Prior Publication Data

US 2020/0239296 A1 Jul. 30, 2020

(30) Foreign Application Priority Data

Sep. 30, 2015 (DE) ..... 10 2015 116 532.5

(51) Int. Cl.
*B67C 3/34* (2006.01)
*B08B 9/08* (2006.01)

(52) U.S. Cl.
CPC ..... *B67C 3/34* (2013.01); *B08B 9/0813* (2013.01)

(58) Field of Classification Search
CPC ..... B67C 3/30; B67C 3/34; B08B 9/0813
See application file for complete search history.

(56) References Cited

U.S. PATENT DOCUMENTS 2,126,563 A 8/1938 Lee
3,045,718 A 7/1962 Reeve
(Continued)

FOREIGN PATENT DOCUMENTS

DE 30 14 746 10/1981
DE 79 23 689 2/1986
(Continued)

*Primary Examiner* — Nicolas A Arnett
(74) *Attorney, Agent, or Firm* — Occhiuti & Rohlicek LLP

(57) ABSTRACT

A treatment head for treating a keg's interior includes a treatment-head housing against which the keg is sealed by having the keg fitting pressed thereon and a lifter that is immovable relative to the treatment-head housing. In response to axial relative movement with the keg fitting, the lifter opens the keg fitting when the keg is sealed against the pressure element, thereby establishing a return gas-path through the treatment head, through a deformable seal and into the keg's interior. This relative movement is carried out against a resetting force. The deformable sleeve is a sleeve-shaped seal that surrounds a space that surrounds at least a portion of an axial extent of the treatment-head housing. A top end of the sleeve connects to the treatment-head housing and a bottom end of the sleeve connects to the pressure element.

20 Claims, 9 Drawing Sheets

(56) References Cited

U.S. PATENT DOCUMENTS

| | | | | | |
|---|---|---|---|---|---|
| 3,799,222 | A * | 3/1974 | Franz | B67C 3/2634 | 141/291 |
| 3,848,645 | A * | 11/1974 | Franz | B67C 3/16 | 141/117 |
| 4,688,608 | A * | 8/1987 | Puskarz | B67C 3/10 | 141/181 |
| 5,125,440 | A * | 6/1992 | Mette | B67C 3/204 | 141/145 |
| 7,455,082 | B2 * | 11/2008 | Monzel | B08B 9/0813 | 141/113 |
| 8,505,594 | B2 * | 8/2013 | Krulitsch | B67C 3/2608 | 141/104 |
| 10,005,653 | B2 * | 6/2018 | Clusserath | B67C 3/06 | |
| 10,358,332 | B2 * | 7/2019 | Clusserath | B67C 3/286 | |
| 2014/0360624 | A1 * | 12/2014 | Clusserath | B67C 3/2637 | 141/91 |
| 2015/0191338 | A1 * | 7/2015 | Krulitsch | B67C 3/2614 | 141/129 |

FOREIGN PATENT DOCUMENTS

| | | | | |
|---|---|---|---|---|
| DE | 295 19 333 | | 1/1997 | |
| DE | 198 42 927 | | 6/1999 | |
| DE | 10 2012 10352 | | 10/2013 | |
| DE | 10 2012 014 9 | | 5/2014 | |
| DE | 102012014957 | A1 * | 5/2014 | B67C 3/26 |
| EP | 1 741 665 | | 1/2007 | |
| FR | 2 851 764 | | 9/2004 | |
| GB | 1 300 061 | | 12/1972 | |
| JP | 2004210384 | A | 7/2004 | |
| JP | 2007-15768 | A | 1/2007 | |
| JP | 2007039084 | A | 2/2007 | |
| JP | 2009533281 | A | 9/2009 | |
| JP | 2015523291 | A | 8/2015 | |
| WO | WO03/014003 | | 2/2003 | |
| WO | 2007/118607 | A1 | 10/2007 | |
| WO | WO2009/141061 | | 11/2009 | |
| WO | WO2015/169579 | | 11/2015 | |
| WO | WO2016/169925 | | 10/2016 | |
| WO | WO2016/207006 | | 12/2016 | |
| WO | WO2016/207031 | | 12/2016 | |

* cited by examiner

METHOD, AS WELL AS TREATMENT STATION AND TREATMENT HEAD FOR TREATING THE INTERIOR OF KEGS, AND SEAL FOR USE IN A TREATMENT STATION OF THIS TYPE

RELATED APPLICATIONS

This is the national stage under 35 USC 371 of international application PCT/EP2016/070480, filed on Aug. 31, 2016, which claims the benefit of the Sep. 30, 2015 priority date of German application DE10-2015-116-532.5, the content of which is herein incorporated by reference.

FIELD OF INVENTION

The invention relates to container treatment, and in particular, to treatment of kegs.

BACKGROUND

Known keg-treatment methods involve opening a keg fitting by moving a lifter relative to a treatment-head housing against which a keg's fitting is sealed. This requires sliding seals. These sliding seals are difficult to clean.

SUMMARY

An object of the invention is to provide a method for treating the interiors of kegs equipped in each case with at least one keg fitting, this method allowing for the treatment to be carried out with high operational reliability and with the avoidance of the disadvantages of known methods and with the use of treatment stations and treatment heads with simplified structural design.

According to the invention, the opening of the respective keg fitting only takes place when the keg to be treated is adequately tightly in contact, i.e. in an adequate sealing position, with its keg fitting at the treatment head, i.e. in a fitting contact that is formed by the mating and contact pressure element, movable relative to the treatment head housing. The opening of the respective keg fitting takes place not due to an axial movement of a lifter relative to the treatment head or its housing, but by way of a feed-and-mating stroke with which the keg to be treated is pressed with its keg fitting against the treatment head or to its mating and contact pressure element and/or the entire treatment head is pressed with its housing against the keg fitting.

The feed-and-mating stroke is compound stroke that has two parts: a first stroke and a second stroke. In the first stroke, the sealing position of the keg that is to be treated is established with the treatment head. After reaching this sealing position, there then takes place, for example, a tightness test of the treatment head, i.e. of the flow paths or flow channels formed in the treatment head, and of the connection between the treatment head and the keg which is to be treated, with the keg fitting still closed and/or the external treatment of the keg concerned. Only at the second stroke of the feed-and-mating stroke is the keg fitting of the keg to be treated opened by the lifter, which then, at this further stroke, projects over the fitting contact, which with this further stroke deflects against a resetting force or spring force.

In a further embodiment, the invention also relates to a treatment head for the treatment and/or filling of the interiors of kegs, equipped in each case with at least one keg fitting, or for use with treatment stations for treating the interiors of kegs equipped in each case with at least one keg fitting.

A particular feature of this treatment head is that media valves required for the controlling of the treatment media are provided directly at the housing of the treatment head, and, in a particularly advantageous further embodiment, with their valve seats directly in flow paths or flow channels formed in the treatment head housing.

In a preferred embodiment of the treatment head, some media valves, and preferably all the media valves, which control the feed of different treatment media, are provided with their valve seats directly at a common flow channel. With the treatment head in use, this is then oriented with its axis vertical or essentially vertical, and, with the keg fitting opened, opens at one end, for example at a lower end, into the interior of the keg which is to be treated, or into a riser tube of the keg to be treated, which is likewise oriented with its axis vertical or essentially vertical.

Due to the special configuration of the treatment head, shortened flow paths with reduced volume are derived, which are common for different treatment media, as a result of which mixing phases between different treatment media, used one after another, are substantially reduced, as too are product losses, i.e. losses of filling product (e.g. beverage), and cleaning and disinfection times are substantially shortened.

In order to monitor the treatment media, in particular also the presence of these media, and/or their volume flow and/or their pressure, corresponding sensors are likewise provided at the housing of the treatment head or in the flow channels or flow paths located there.

As used herein, "treatment" includes a treatment of the interior of the keg with different treatment media and/or cleaning media and/or disinfection media, for example with water, with hot water, with at least one gaseous and/or vaporous treatment medium, with at least one treatment medium containing hydrogen peroxide, with inert gas, such as carbon dioxide gas, and in particular also with an inert gas or carbon dioxide gas under pressure.

As used herein, "treatment" also includes flushing of the keg interior with an inert gas, preferably introduced under pressure, for example with sterile air and/or with a carbon dioxide gas, the evacuation of the keg interior, and, in particular also the pre-tensioning of the keg interior with a sterile vaporous and/or gaseous medium under pressure, in particular with an inert gas, such as carbon dioxide gas, under pressure, and the filling of the keg interior with the filling product.

In a further embodiment, the invention relates to a seal in the form of a sleeve or casing, i.e. a seal with an axial wall in the form of a hollow cylinder, for use with the treatment head for the treatment of the interiors of kegs equipped in each case with at least one keg fitting, and specifically for the formation of a flexible wall, sealed against the surrounding environment and forming a gas path, for example a return gas path, between the housing of the treatment head and the mating and contact pressure element, movable against the resetting force.

As used herein, "essentially" or "approximately" refer to deviations from an exact value in each case by ±10%, preferably by ±5%, and/or deviations in the form of changes that are not of significance for the function.

Further embodiments, advantages, and possible applications of the invention are also derived from the following description of exemplary embodiments and from the figures. In this context, all the features described and/or pictorially represented, individually or in any desired combination, are in principle the object of the invention, regardless of their relationship in the claims or reference to them. The contents of the claims are also made constituent parts of the description.

BRIEF DESCRIPTION OF THE DRAWINGS

These and other features of the invention will be apparent from the following detailed description and the accompanying figures, in which.

DETAILED DESCRIPTION

Figure 1:
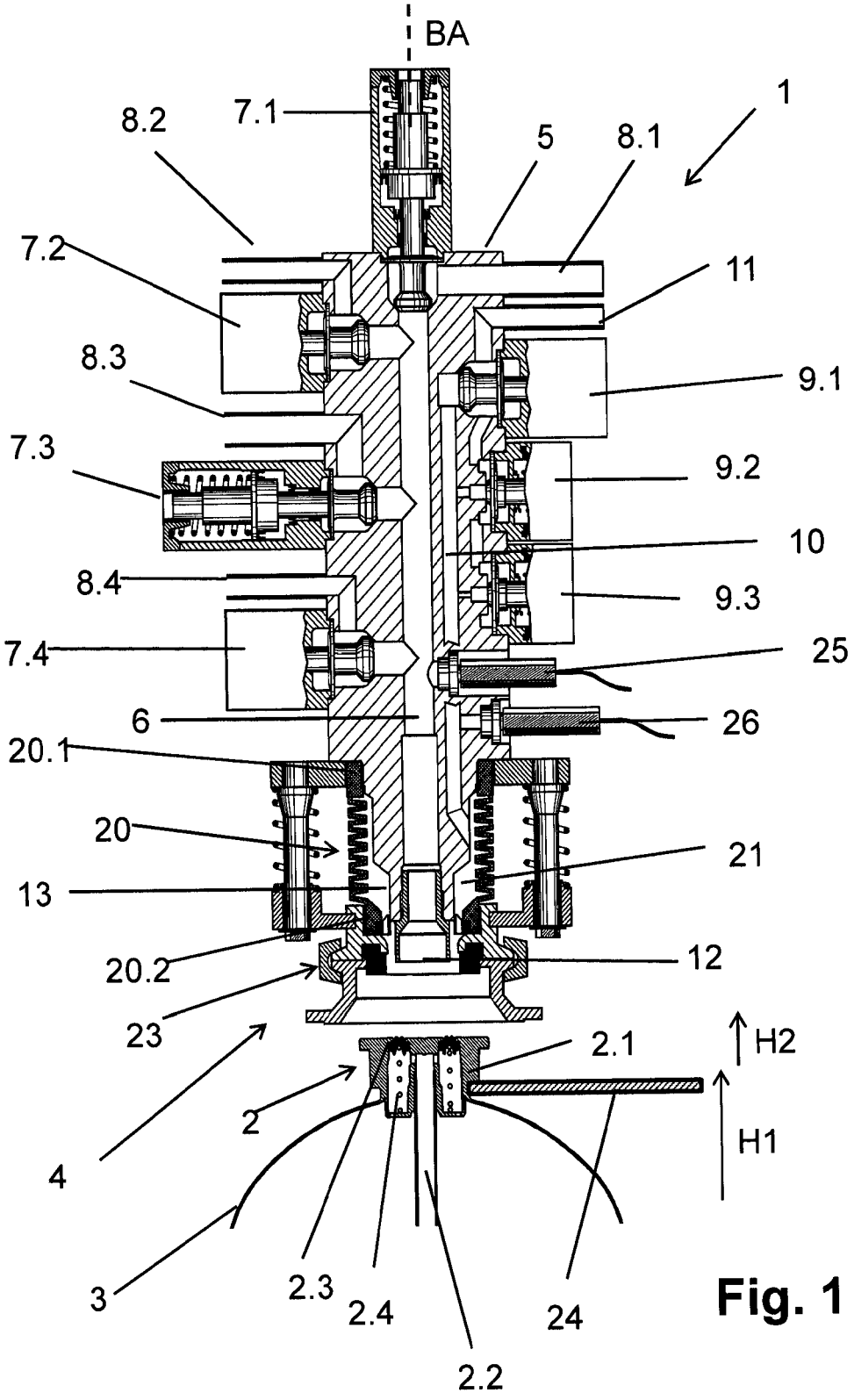
FIGS. 1-3 show a treatment head of a keg treatment station in different operational states of the keg treatment station.

FIGS. 1-4 show a keg-treatment station 1 for treating kegs 3, equipped with a keg fitting 2. For the treatment, the kegs 3 are arranged with their keg fittings 2 lying upwards. Each keg fitting 2 includes a fitting housing 2.1, a riser tube 2.2 arranged in the middle in the fitting housing 2.1, and a ring-shaped valve body 2.3. A spring contacts valve surfaces at the fitting housing 2.1 and at the tubular riser 2.2. This spring pre-tensions the valve body 2.3 into its closed position.

Between the fitting housing 2.1 and the riser tube is a ring channel 2.4. With the keg fitting 2 closed, the valve body 2.3 closes the riser 2.2 and the ring channel 2.4.

The keg handling station 1 includes a treatment head 4 having a treatment head housing 5, either of which is held on the keg-treatment machine's frame. Within the treatment head 4 is a flow channel 6 that is coaxial with a treatment-head axis BA.

Within the treatment head, first media valves 7.1-7.4 open into the flow channel 6 with their valve seats being proximate to the flow channel 6 between the flow channel 6 and external connections 8.1-8.4. In addition, second media valves 9.1-9.3 control internal gas paths formed in the treatment head housing 5 and provide a controlled connection between a return gas-path 10 formed in the treatment head housing 5 and an external connection 11.

Figure 4:
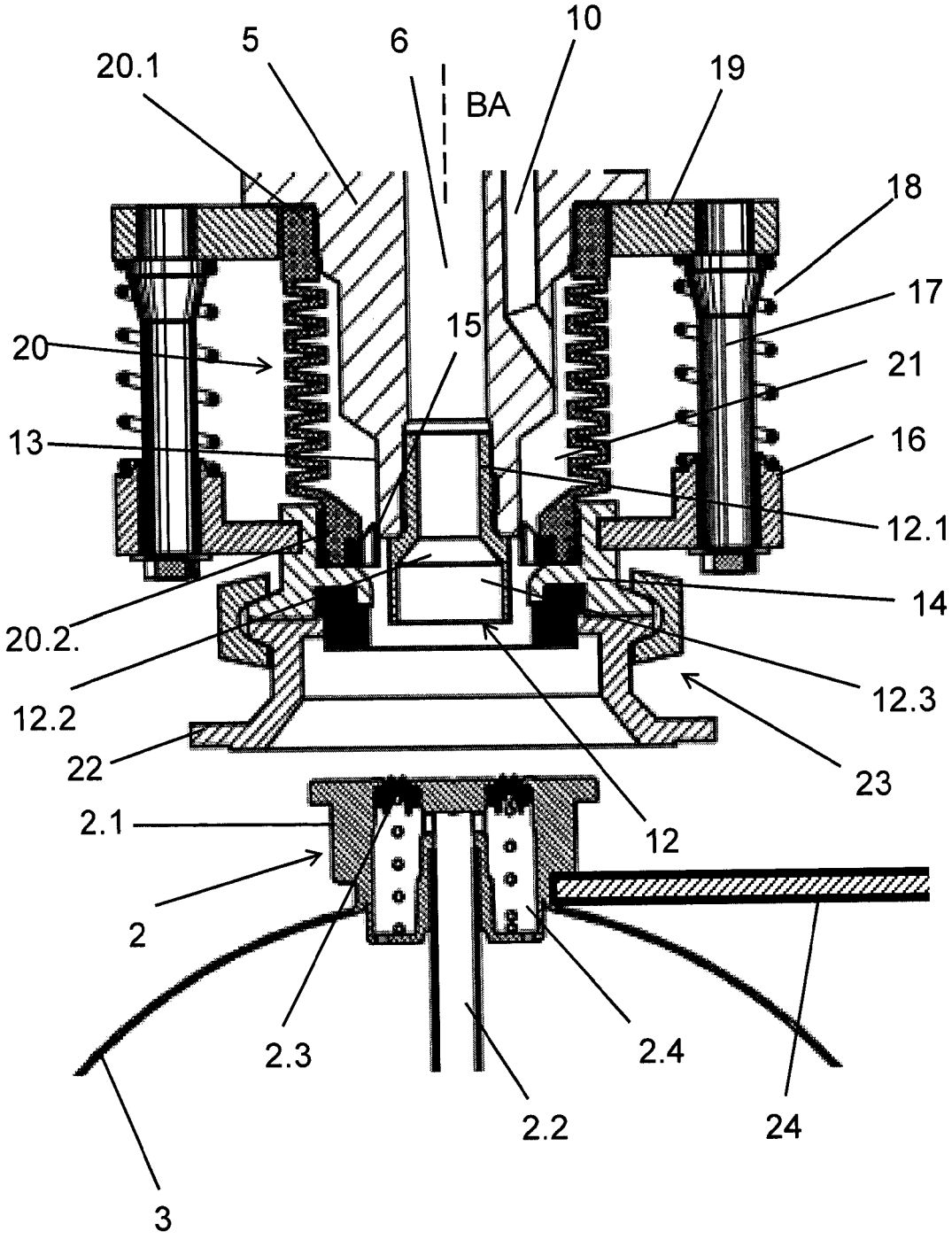
FIG. 4 shows an enlarged detailed representation of FIG. 1.

Referring to FIG. 4, the treatment head 4 includes a lifter 12 at the lower end of the treatment head housing 5. For treatment of flat fittings, the lifter 12 is a beaker lifter or as a rotationally-symmetrical hollow body that is open at both ends and arranged coaxially with the treatment head axis BA. For treatment of basket fittings, the lifter 12 has a sleeve section 12.1 that projects into the lower open end of the flow channel 6 and is held in the flow channel 6 so that it is sealed against and immovable relative to the treatment head housing 5.

The lifter 12 has a funnel section 12.2 and a cylindrical section 12.3. The lifter's funnel section 12.2 forms a taper that begins at the sleeve section 12.1 and widens until it joins the cylindrical section 12.3, thus forming an inverted funnel. The inner and outer diameters of the lifter's cylindrical section 12.3 are thus larger than the corresponding inner and outer diameter of the sleeve section 12.1 and correspond to the ring diameter of the keg fitting's valve body 2.3. The lifter's funnel section 12.2, and its cylindrical section 12.3 project downwards past the lower end of the treatment head housing 5.

An annular housing-part 14 that is concentric with the treatment-head axis BA surrounds a cylindrical surface 13 at the lower end of the treatment-head housing 5. A slide guide 15 guides the annular housing part 14 as it moves along the treatment-head axis BA.

A lower holding-ring 16 coaxial with the treatment-head axis BA encloses the annular housing-part 14 and engages it along its periphery so that the lower holding-ring 16 and the annular housing-part 14 move together. The lower holding-ring 16 slides along external guide bolts 17 that extent between the lower holding-ring 16 and an upper holding-ring 19 that is also coaxial with the treatment-head axis BA. The upper holding-ring 19 surrounds an outer surface of the treatment-head housing 5 and connects to the treatment head-housing 5.

These external guide-bolts 17 have their axes parallel to the treatment-head axis BA. A spring 18 corresponding to each external guide-bolt 17 surrounds that external guide-bolt 17. These springs 18 collectively urge the lower holding-ring 16 downward, thus biasing the annular housing-part 14 towards a lower end position.

A seal 20 defines a sleeve that is coaxial with the treatment-head axis BA. As such, the seal 20 surrounds and encloses the lower region of the treatment head housing 5.

The seal defines a deformable section 20.3 that extends between reinforced upper and lower support sections 20.1, 20.2. The deformable section 20.3 has a variable extent along the treatment-head axis BA. In the illustrated embodiment, the deformable section 20.3 is a bellows. The upper support section 20.1 engages an outer surface of the treatment-head housing 5 above the annular housing-part 14. The lower support section 20.2 engages the annular housing-part 14 and forms the slide guide 15.

The annular housing-part 14 and the seal 20 cooperate to define a wall that can be moved relative to the treatment head housing 5 in the direction of the treatment-head axis BA. This wall eliminates the need for an inner slide-seal.

The seal 20 encloses a ring space 21 into which the return gas-path 10 opens. Except for a few openings formed in the region of the slide guide 15, the ring space 21 is closed to the surrounding environment and also to the flow channel 6.

A centering element 22 lies sealed to an underside of the annular housing-part 14. In doing so, the centering element 22 and the annular housing-part 14 cooperate to form a spring-loaded pressure element 23 that mates against the keg fitting 2 to form a seal. In the illustrated embodiment, the centering element 22 includes a centering tulip.

During the keg's treatment, a keg holder 24 engages a lower surface of the keg fitting 2. During a feed-and-mating movement, the keg holder 24 and a lifting mechanism cooperate to raise the keg 3 out of the initial position shown in FIG. 1 and into a treatment position at the treatment head 4, as shown in FIG. 2. Once in the treatment position, the keg fitting 2.1 seals against the spring-loaded pressure element 23.

The feed-and-mating movement begins with a first stroke H1 that raises the keg 3 along the treatment-head axis BA so that it pushes up against spring-loaded pressure element 23 and compresses the springs 18. This forms a seal but without causing the lifter 12 to open the keg fitting 2. As a result, the lifter 12 remains positioned with its lower edge still above the closed fitting valve body 2.3, as shown in FIG. 2.

At this position, the keg treatment-station 1 carries out a sealing-tightness test to see if the seal is tight enough. This proceeds by opening one or more of the first media valves 7.1-7.4. Doing so subjects the flow channel 6, the ring space 21, the return gas-path 10, and also the space closed by the keg fitting 2 and formed inside the mating and contact pressure element 23 to a gaseous medium under pressure.

A first sensor 25 couples to the flow channel 6 and a second sensor 26 couples to the return gas-path 10. Based on the pressures sensed by the first and second sensors 25, 26, it is possible to determine whether a tight sealed connection has been achieved between the treatment head 4 and the keg fitting 2.

As an alternative to or in addition to carrying out the sealing-tightness test, the keg-treatment station 1 flushes the interior of the treatment head 4 and the fitting. In addition, the keg-treatment station 1 carries out an optional of cleaning the keg's exterior.

Figure 3:
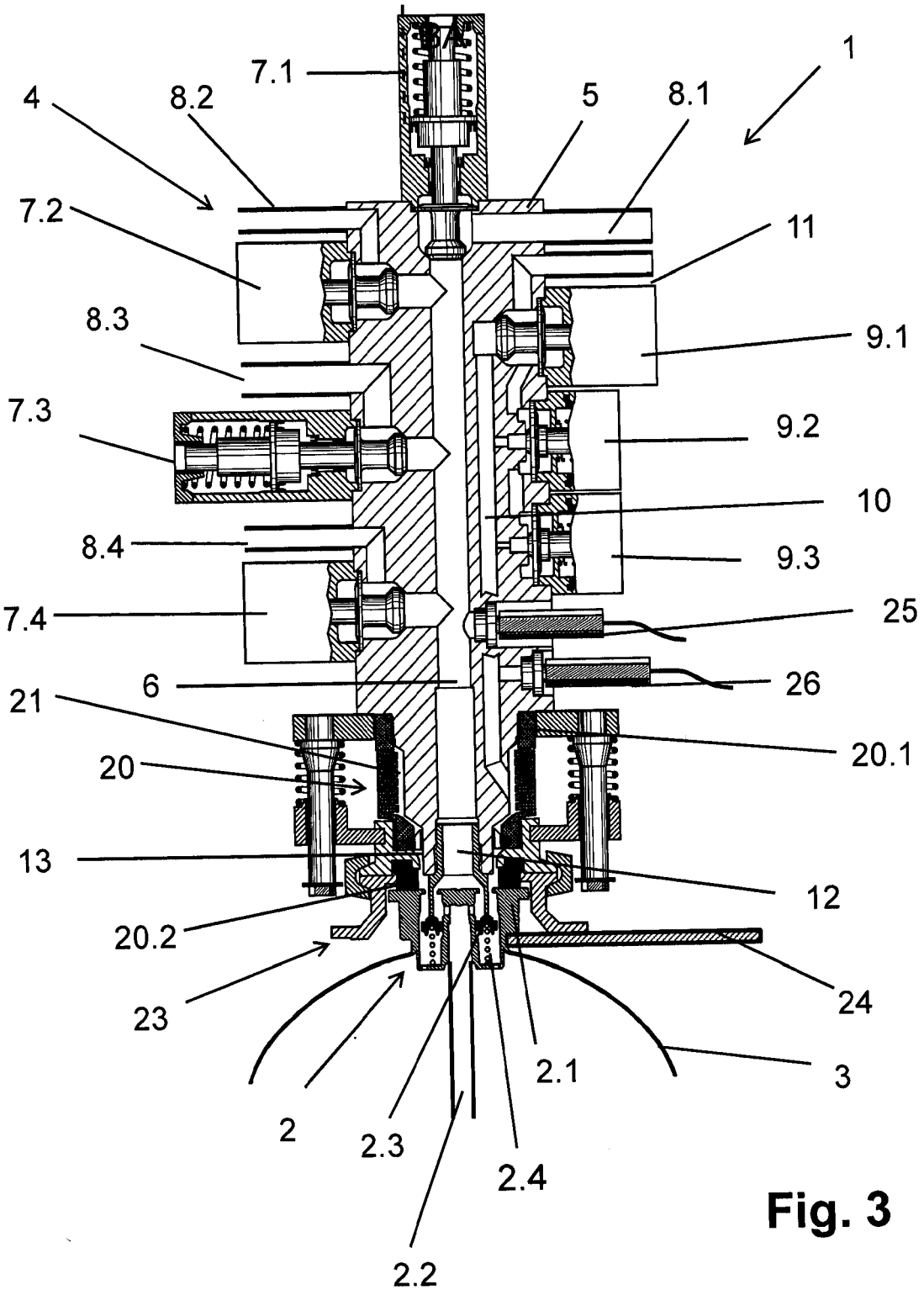

After the first stroke H1, the keg-treatment station 1 carries out a second stroke H2. This includes having the keg holder 24 and a lifting mechanism cooperate to raise the keg 3 further so that the keg fitting 2 pushes against the pressure element 23, thus causing the lifter 12 to move the valve body 2.3 downward and opening the keg fitting 2, as shown in FIG. 3.

With the valve body 2.3 still pushed downward, the keg-treatment station 1 opens the first and second media valves 7.1-7.4, 9.1-9.3 to cause treatment of the keg's interior. This treatment proceeds by introducing appropriate media via the flow channel 6, the lifter 12, and the riser tube 2.2 into the keg's interior for cleaning and/or sterilizing the keg's interior and removing the treatment via the ring channel 2.4, the ring space 21, and the return gas-path 10. An alternative practice includes the reverse of this procedure. This alternative practice features introducing treatment media via the ring channel 2.4 and removing it via the riser tube 2.2.

After the above preliminary treatment, the keg-filling station 1 causes pressurized pre-tensioning gas to enter the keg's interior. A suitable pre-tensioning gas is an inert gas, such as carbon dioxide. This results in flushing and pre-tensioning the keg's interior prior to filling with liquid filling product through the keg fitting 2, which remains open as a result of the lifter 12. The flow channel 6, lifter 12, and immersion tube 2.2 convey the pre-tensioning gas from an appropriate one of the first media valves 7.1-7.4.

The keg-filling station 1 then fills the keg 3 with liquid filling-material through the still opened keg fitting 2. This is carried out by opening whichever one of the first media valves 7.1-7.4 connects to a source of the liquid filling-material and closing it when the required quantity of liquid filling-material has been reached. The liquid filling-material passes through the flow channel 6, the lifter 12, and the immersion tube 2.2 on its way into the keg's interior.

As the liquid filling-material enters the keg's interior, the pre-tensioning gas escapes via the ring space 21 and the return gas-path 10, through at least one of the second media valves 9.1-9.3.

The treatment media controlled by the first and second media valves 7.1-7.4, 9.1-9.3 thus run the gamut from treatment media for the cleaning and/or disinfection of the keg interior, such as, for example, water, also hot water, gaseous and/or vaporous treatment media, treatment media containing hydrogen peroxide, and/or media which is used at the actual filling of the keg 3 with the filling substance or product, such as vacuum, inert gas, e.g. carbon dioxide gas, in particular also inert gas or carbon dioxide under pressure, for the flushing and/or pre-tensioning of the keg interior, as well as the liquid filling-material to be introduced into the kegs 3 during the filling operation.

FIGS. 5-8 show operational states that correspond to those shown in FIGS. 1-4 for a further embodiment of a keg treatment station 1*a* with a treatment head 4*a*. This further embodiment essentially differs from the treatment head 4 only in that only the first media valves 7.1-7.3 are provided at the treatment head housing 5. FIGS. 5-8 thus omit the second media valves 9.1-9.3.

Figure 2:
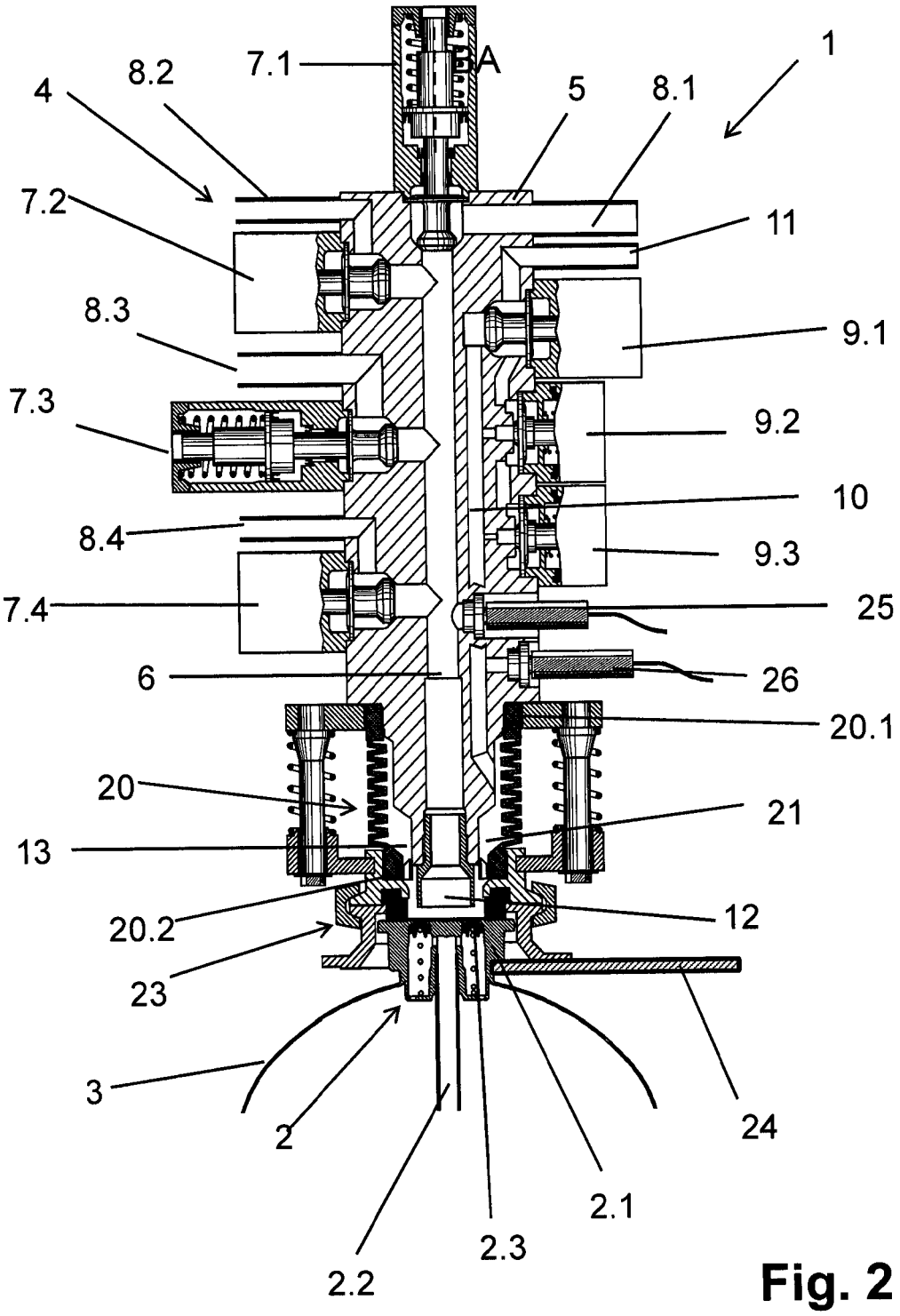

The treatment head 4*a* otherwise corresponds to the treatment head 4, with the result that such function elements of the treatment head 4*a* that, at least from the point of view of function, correspond to the elements of the treatment head 4, are designated by the same reference numbers as in FIGS. 1-3. For the sake of simpler representation, the guide bolts 17 and the springs 18 are not shown in FIGS. 5-8. It is understood, however, that the mating and contact pressure element 23 is spring-loaded in the same way described in connection with FIGS. 1-4.

Figure 5:
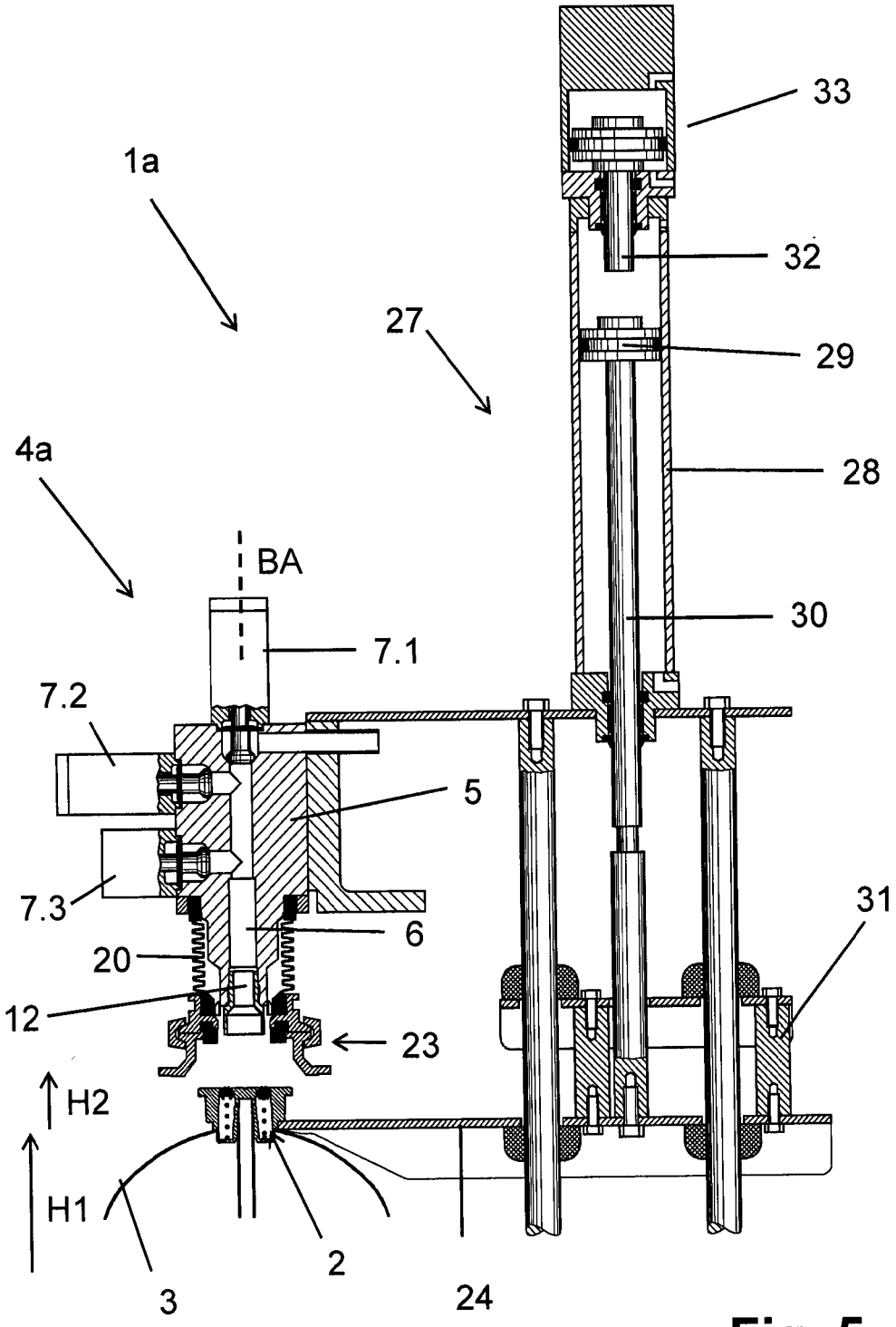
FIGS. 5-7 shows views similar to those FIGS. 1-3 but for a further embodiment of the invention.

FIG. 5 shows the keg 3 before it has been raised to reach the mating and contact pressure element 23.

Figure 6:
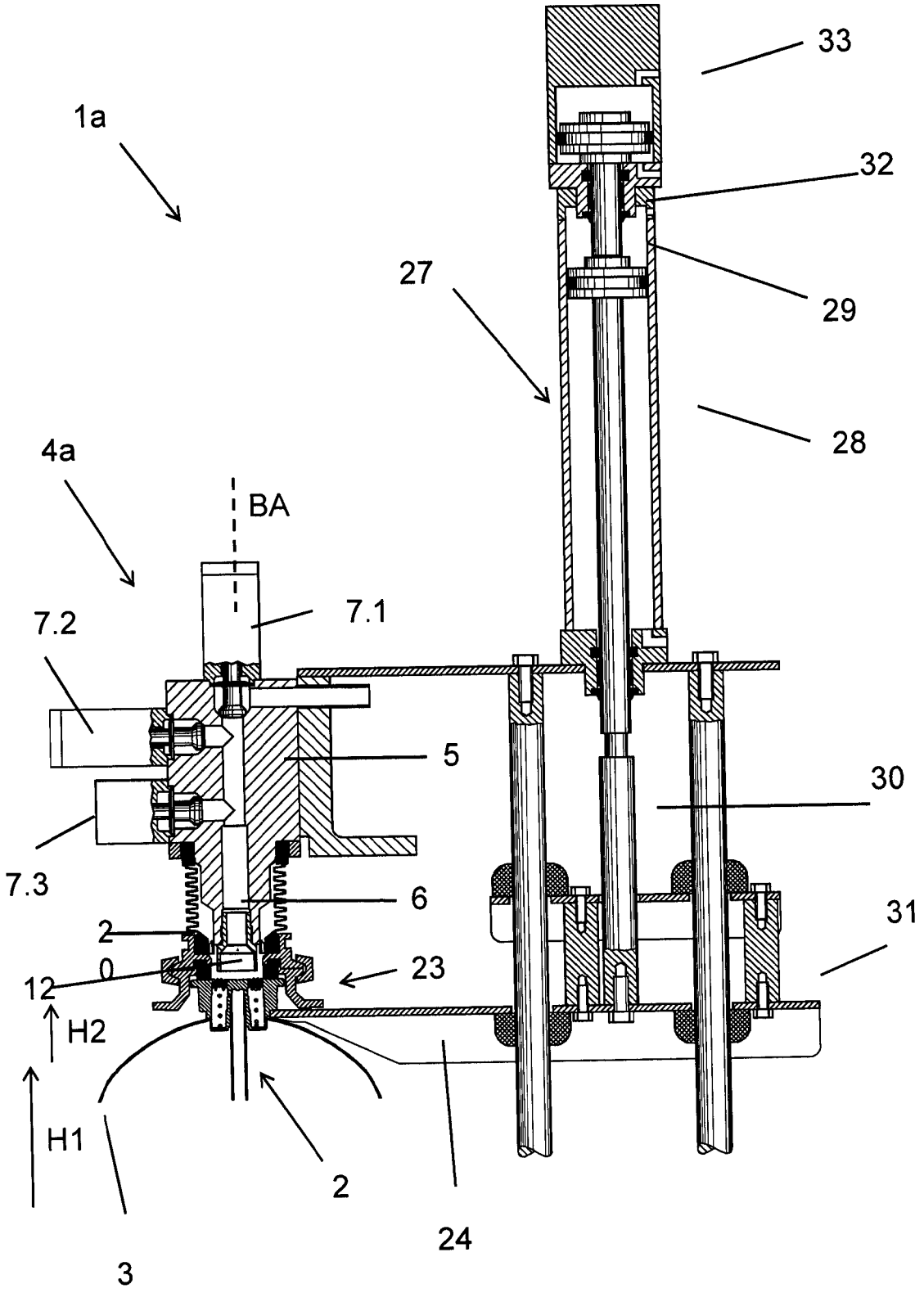

FIG. 6 shows the keg 3 at the end of the first stroke H1, at which point has been raised into contact against the treatment head 4*a*, and in particular, against the mating and contact pressure element 23. However, the keg fitting 2 remains closed.

FIG. 6 shows the keg 3 after the second part stroke H2. The keg fitting 2 has now been opened. In the immediate proximity of the flow channel 6 are the three first media valves 7.1-7.3 or, respectively, their valve seats formed in the treatment head housing 5.

Figure 7:
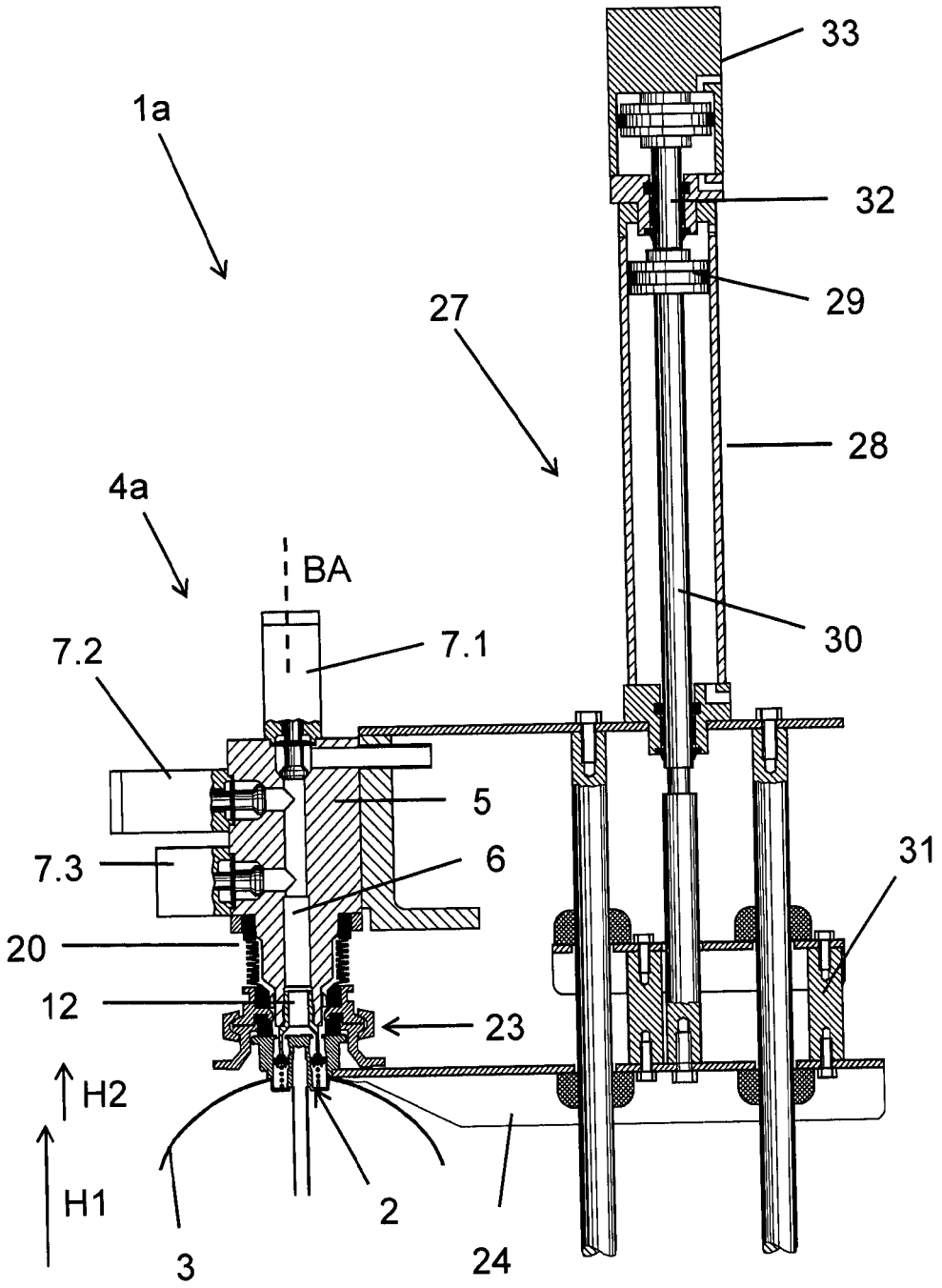
Figure 8:
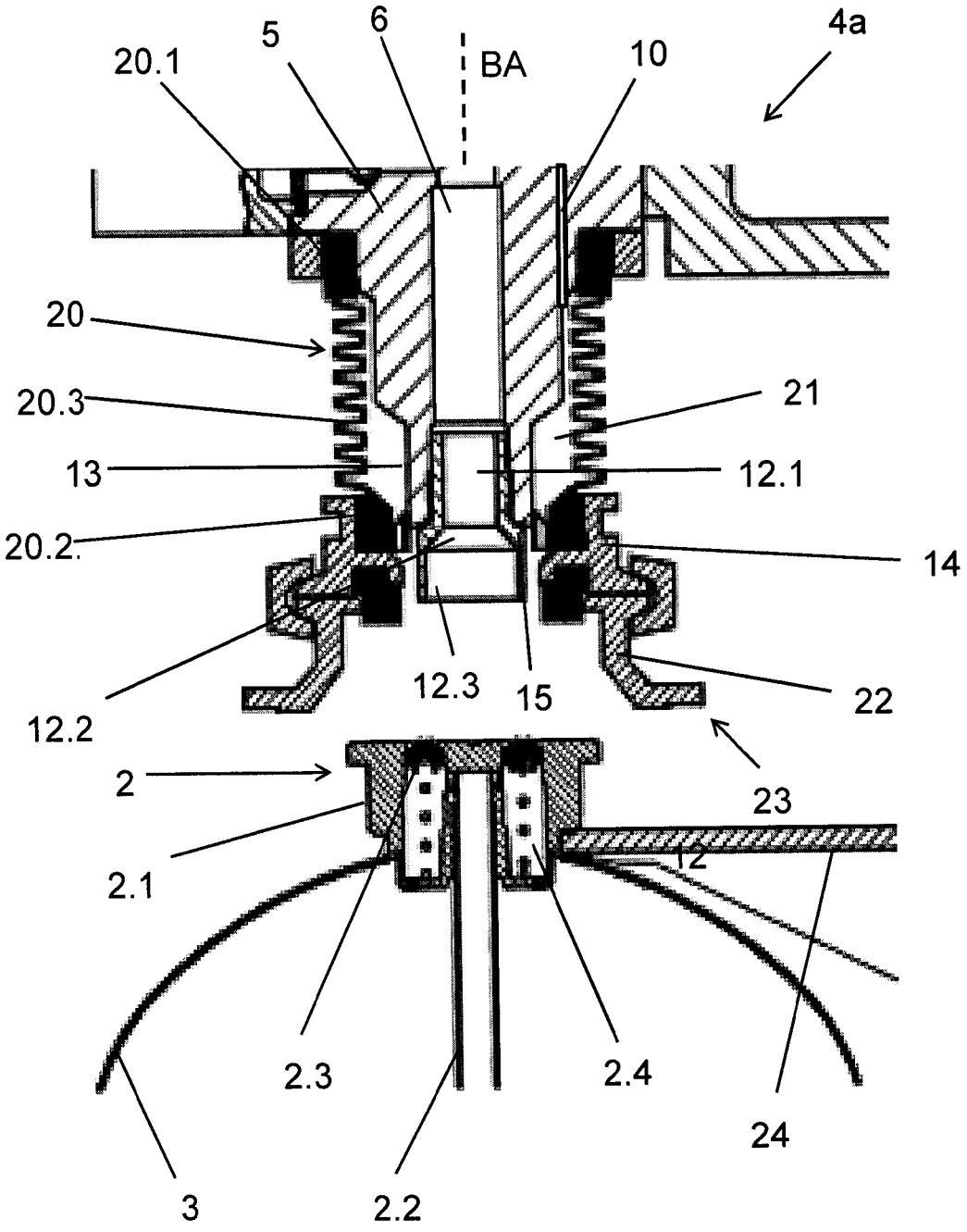
FIG. 8 shows an enlarged detailed representation of FIG. 5.

FIGS. 5-7 show a lifting device 27 that causes the first and second strokes H1, H2. The lifting device 27 comprises a lifting cylinder 28. In some embodiments, the lifting cylinder 28 is a pneumatic cylinder. Within the cylinder 28 is a piston 29 that couples to a carriage 31 via a piston rod 30. Movement of the piston 29 thus causes axial movement of the carriage 31 along an axial direction that is parallel to the treatment-head axis BA. The piston's movement ultimately raises and lowers the keg holder 24.

An ancillary cylinder 33 above the lifting cylinder 28 having a ancillary piston rod 32 that descends downward and functions as a stop for upward travel by the piston 29.

To carry out the first stroke H1, the keg-treatment station 1 pressurizes both the ancillary cylinder 33 and the portion of the lifting cylinder 28 underneath the piston 29. Doing so drives the piston 29 upward, thus raising the carriage 31 and the keg holder 24. Once the piston 29 reaches the ancillary piston rod 32, the pressure in the ancillary cylinder 33 stops the piston rod's further upward travel. This completes the first stroke H1.

To carry out the second stroke H2, the keg-treatment station 1 relieves the pressure in the ancillary cylinder 33 while maintaining the pressure in the lifting cylinder 22. This allows the piston 29 to push against the ancillary piston rod 32 and move it upward, thus moving the keg holder 24 further upward. This completes the second stroke H2.

The figures show just one of many embodiments of the lifting device 27 for raising and lowering the keg holder 24. Other configurations of this lifting device are also possible.

Another special feature of the treatment head 4, 4*a* is that, for the opening of the respective keg fitting 2, an axial movement of the lifter 12 relative to the treatment head housing 5 comprising this lifter 12 does not take place. Instead, opening occurs after a second stroke H2 at the raising of the keg 3 against the container treatment head 4. This is because the spring-loaded mating and contact pressure element 23 forms the seal between the keg 3 and the treatment head 4. This can be moved axially relative to the treatment head housing 5 for the opening of the keg fitting 2. With the keg fitting 2 opened, the seal 20 defines a flow path leading via the ring space 21 in connection with the keg interior and sealed from the outside, for example a return gas path. This avoids sliding seals that are difficult to clean to begin with and that are made even more difficult to clean by being located in the interior.

The opening of the keg fitting 2 therefore takes place by a movement that takes place outside the respective treatment head 4, 4*a*. This extra movement is the additional raising of the respective keg 3 by the second stroke H2. The treatment head 4, 4*a* remains sealed during his movement because of the deformable seal 20 that surrounds the lower region of the treatment head housing 5 and the ring space 21.

A further special feature of the keg treatment stations 1, 1*a* and their treatment heads 4, 4*a* is that the first media valves 7.1-7.4, which control the introduction and/or removal of treatment media as well as the introduction of the liquid filling-product into and out of the flow channel 6, and their valve seats, and also the second media valves 9.1-9.3 and their valve seats, are provided in the treatment head housing 5 and in immediate proximity to the flow paths or flow channel 6 and the return gas-path 10 respectively. This avoids external connection lines in the form of pipes or hoses. This also results in short flow paths with reduced volume inside the treatment head 4, 4*a*. The short flow paths mean substantially reduce mixed phases between the different treatment media, losses of product or filling material, and times required for the cleaning and/or disinfection of the treatment head 4, 4*a*.

Figure 9:
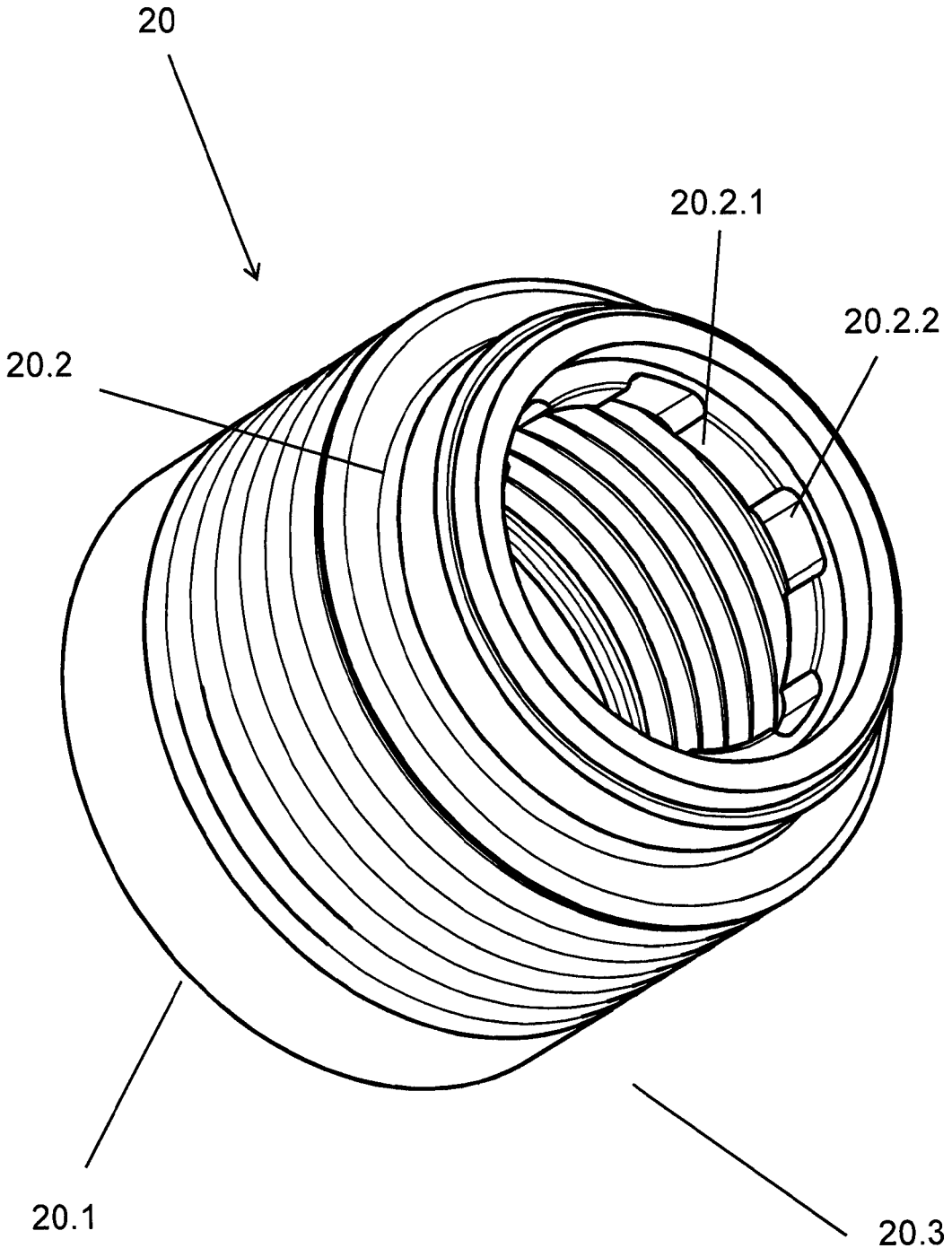
FIG. 9 shows a seal in the form of a sleeve or casing of the treatment head from FIGS. 1-8.

FIG. 9 again shows the seal 20 in greater detail. The seal 20 is configured as a folding bellows seal. The deformable section 20.3 is preferably made of plastic, for example of polytetrafluorethylene. The seal 20 exhibits a pressure resistance for an inner pressure of up to maximum 6 bar, for example some 4 to 5 bar.

It is not essential, however, for the seal in the form of a sleeve or casing to be formed as one piece with the upper and lower support sections 20.1, 20.2 being ring-shaped support elements. The upper and lower support sections 20.1, 20.2 can also be produced separately, for example from a different material, and then connected to the seal 20 in a suitable manner, or even inserted into it.

The lower support-section 20.2, which slides on the cylindrical surface 13 of the treatment head housing 5, forms the slide guide 15 for the annular housing-part 14. Raised regions 20.2.1 on the lower support-section 20.2 form the actual sliding surface on which the lower support-section slides on the cylindrical surface 13. These and the cylindrical surface 13 are easy to clean and sterilize. Recessed regions 20.2.2 between the raised regions 20.2.1 form the openings via which the ring space 2.1 connects to the keg's interior when the keg 3 is sealed against the treatment head 4, 4*a* with the keg fitting 2 opened.

It has been assumed heretofore that the movement of the keg 3 relative to the treatment head 4, 4*a* takes place in two discrete steps, namely the first and second strokes H1, H2 separated by a short time interval. However, nothing stops the time interval from being decreased. In the limit, the time interval decreases to zero, with the result being that the first and second strokes H1, H2 merge into one continuous stroke having two separate stroke portions H1, H2.

It is understood that the keg fitting 2 does not open until the keg 3 has been sealed against the mating and contact pressure element 23. For this purpose the mating and contact pressure element 23 is conveyed with the keg fitting 2 in contact with it against the effect of the springs 18 so far that the pressure springs 1 can apply the contact pressure required to seal the keg 3 at the treatment head 4.

In the illustrated embodiment, the seal 20 is a folding bellows seal. Other seals can also be used, provided that they are axially deformable in some way. These include axially deformable or axially elastically deformable structures, for example those in the form of roll membranes.

It has further been assumed heretofore that the keg 3 is moved, for the movement to the treatment head 4, 4*a*, in the feed-and-mating stroke, for example held suspended on the keg holder 24 or on another container carrier. However, the principle concerned relies only the relative movement between the treatment head 4, 4*a* and the lifter 12. It is in principle also possible for the treatment head 4, 4*a* to carry out the feed-and-mating stroke instead of the lifter 12. The treatment head 4, 4*a* would then preferably exhibit the configuration described heretofore.

It has further been assumed heretofore that the keg 3 is positioned beneath the treatment head 4, 4*a*, such as is advantageous in particular for such kegs as are provided with a neck ring and are handled by means of neck handling. This is not essential, however. As a deviation from this, arrangements are also provided with which the keg 3 is positioned above the treatment head 4, 4*a*, as is particularly suitable for kegs that are handled in the conventional manner, i.e. with the fitting oriented downwards and contact pressure at the treatment head 4, 4*a* by way of a contact pressure device taking effect on the bases of the kegs, oriented facing upwards.

The invention claimed is:

1. An apparatus comprising a seal, said seal being a deformable seal that comprises a first annular support, a second annular support, and a cylindrical wall extending between said first annular support and said second annular support, said cylindrical wall being a deformable wall, wherein a distance between said first and second annular supports depends on an extent to which said cylindrical wall has deformed, a treatment head for treatment of an interior of a keg that has been equipped with a keg fitting, wherein said treatment head comprises a housing, wherein said seal surrounds a space that surrounds at least a portion of an axial extent of said housing, wherein said treatment head defines a return-gas path through said seal, wherein said treatment head further comprises a pressure element against which said keg is sealed at said housing by having said keg fitting pressed thereon, and a lifter that is immovable relative to said housing, wherein, in response to relative movement between said keg fitting and said lifter along an axial direction of said housing, said lifter opens said keg fitting when said keg is sealed against said pressure element, thereby establishing said return gas-path through said treatment head, through said seal, and into said keg's interior, wherein said relative movement is carried out against a resetting force, and wherein a top end of said seal connects to said housing and a bottom end of said seal connects to said pressure element.

2. The apparatus of claim 1, wherein an inner surface of said first annular support comprises elevated regions separated by recesses.

3. The apparatus of claim 1, wherein said seal is a bellows seal.

4. The apparatus of claim 1, wherein the seal is a roll membrane seal.

5. The apparatus of claim 1, wherein said seal is made from a single plastic piece.

6. The apparatus of claim 1, wherein said seal is configured to fail at a pressure that exceeds six atmospheres.

7. The apparatus of claim 1, further comprising a sliding surface along which pressure element is guided axially along a surface of said housing, wherein a bottom portion of said seal forms said sliding surface.

8. The apparatus of claim 1, wherein said first annular support comprises a first reinforced ring, wherein said second annular support comprises a second reinforced ring, and wherein said cylindrical wall section extends between said first and second reinforced rings.

9. The apparatus of claim 1, further comprising a plurality of elevated regions, said elevated regions being disposed at a bottom portion of said seal, wherein said elevated regions are spaced apart from each other around a reinforced support ring at said bottom portion.

10. The apparatus of claim 1, further comprising a spring that resists movement of said pressure element relative to said housing, wherein said pressure element is movable against said spring.

11. The apparatus of claim 1, further comprising a flow channel, wherein said keg fitting transitions between an open state, in which a connection is established through said flow channel and extends through a riser tube of said keg fitting, and a closed state, in which said connection is interrupted.

12. The apparatus of claim 1, further comprising first media valves in said return-gas path and second media valves in a flow channel that extends into said keg when said keg fitting is opened, wherein said first and second media valves are configured to cause controlled delivery of fluid into said keg and controlled removal of fluid from said keg.

13. The apparatus of claim 1, further comprising a lifting device for executing a continuous feed-and-mating stroke in which a first portion of said stroke forms a seal between said keg fitting and said pressure element and a second portion of said stroke opens said keg fitting.

14. The apparatus of claim 1, further comprising a lifting device for executing separate and distinct first and second strokes, wherein said first stroke forms a seal between said keg fitting and said pressure element and a second stroke opens said keg fitting.

15. The apparatus of claim 1, further comprising a keg holder and a lifting device configured to move said pressure element toward said keg holder.

16. The apparatus of claim 1, further comprising a first set of media valves and a second set of media valves, wherein said first set of media valves is configured to control flow of fluid through a flow channel formed in said treatment head, wherein said second set of media valves is allocated to control flow of fluid through said return-gas path, wherein said media valves of said first set are arranged in said housing with valve seats thereof in said flow channel, and wherein said media valves of said second set are arranged in said housing with valve seats thereof in said return-gas path.

17. The apparatus of claim 16, wherein said first set of media valves is arranged with valve seats thereof in immediate proximity to said flow channel, wherein, when said keg fitting is open, said flow channel connects to said keg's interior.

18. The apparatus of claim 16, further comprising sensors provided at said head, said sensors being configured to monitor pressure in a flow path through said head and to monitor media flowing through said flow path.

19. The apparatus of claim 1, wherein said seal is made from a single plastic piece of polytetrafluorethylene.

20. The apparatus of claim 1, wherein a cross section of the material from which said first annular support is made is thicker than a cross section of the material from which the cylindrical wall is made and wherein a cross section of the material from which said second annular support is made is thicker than the cross section of the material from which the cylindrical wall is made.

* * * * *